United States Patent [19]

McLain

[11] 4,089,390

[45] May 16, 1978

[54] LADDER HOOK ASSEMBLY AND LADDER

[75] Inventor: Philippe Hardy-Thé McLain, Columbia, S.C.

[73] Assignee: Shakespeare Company, Columbia, S.C.

[21] Appl. No.: 693,859

[22] Filed: Jun. 8, 1976

[51] Int. Cl.[2] ..... E06C 1/36
[52] U.S. Cl. ..... 182/206
[58] Field of Search ..... 182/206, 196, 197, 198, 182/228, 194, 150

[56] References Cited

U.S. PATENT DOCUMENTS

| | | | |
|---|---|---|---|
| 401,742 | 4/1889 | Foote | 182/206 |
| 1,205,594 | 11/1916 | Close | 182/206 |
| 2,946,396 | 7/1960 | McDougal | 182/206 |
| 3,559,763 | 2/1971 | Stern | 182/228 |
| 3,590,951 | 7/1971 | Berger | 182/206 |

*Primary Examiner*—Reinaldo P. Machado
*Attorney, Agent, or Firm*—Kenyon & Kenyon, Reilly, Carr & Chapin

[57] ABSTRACT

The hook assembly includes a hook which passes through a hollow top rung of the ladder and an enclosed locking assembly which secures the hook to the rung for selective rotation between a storage condition and a hooking use condition.

17 Claims, 7 Drawing Figures

Fig. 1.
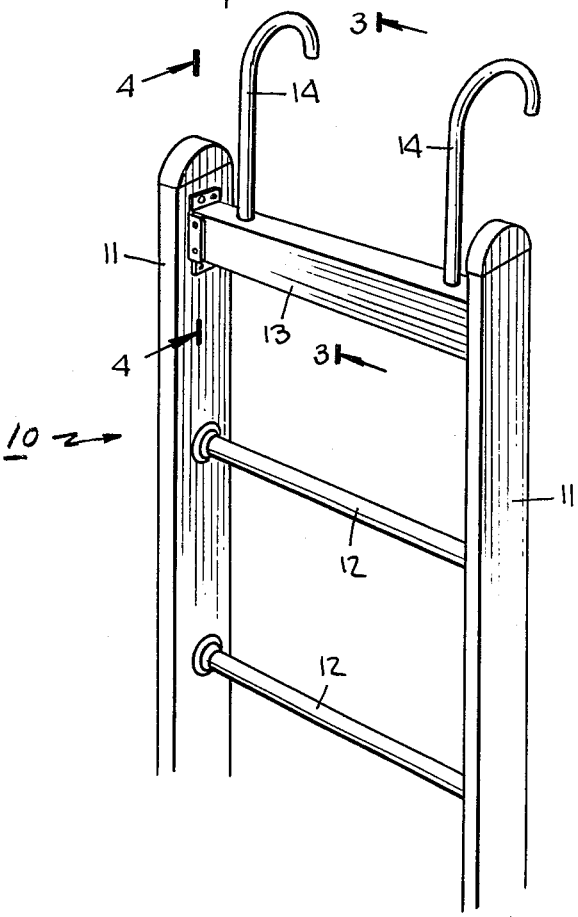
Fig. 2.
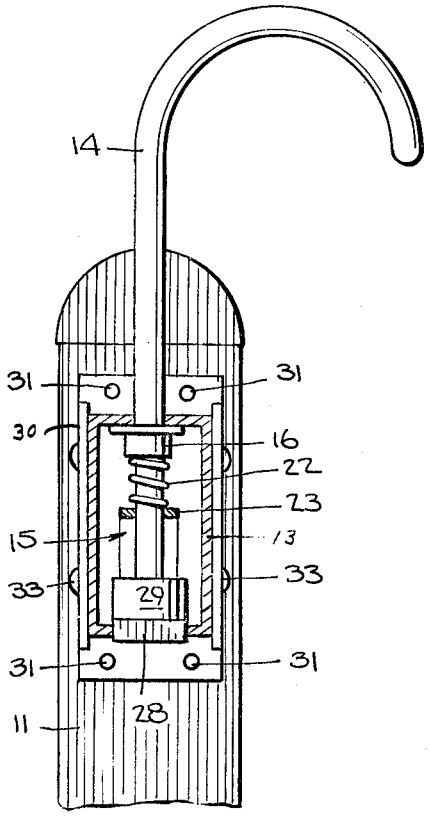
Fig. 3.
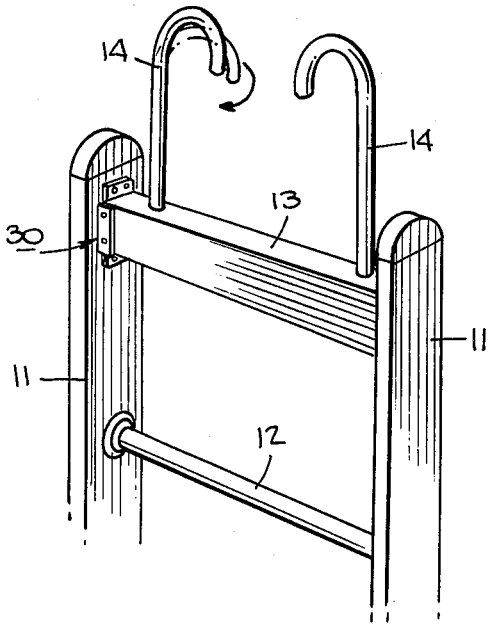
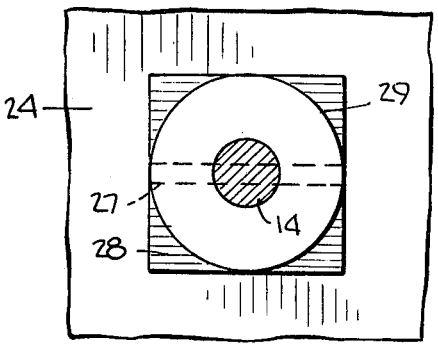
Fig. 7.

Fig. 4.
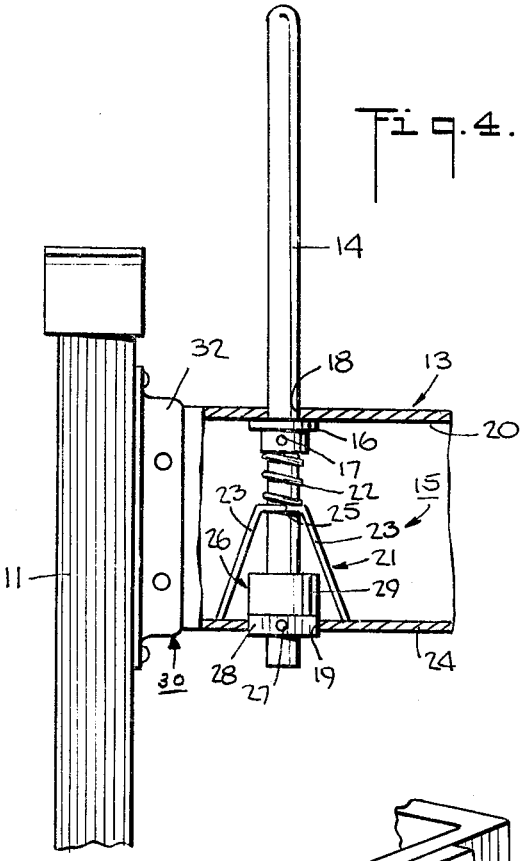
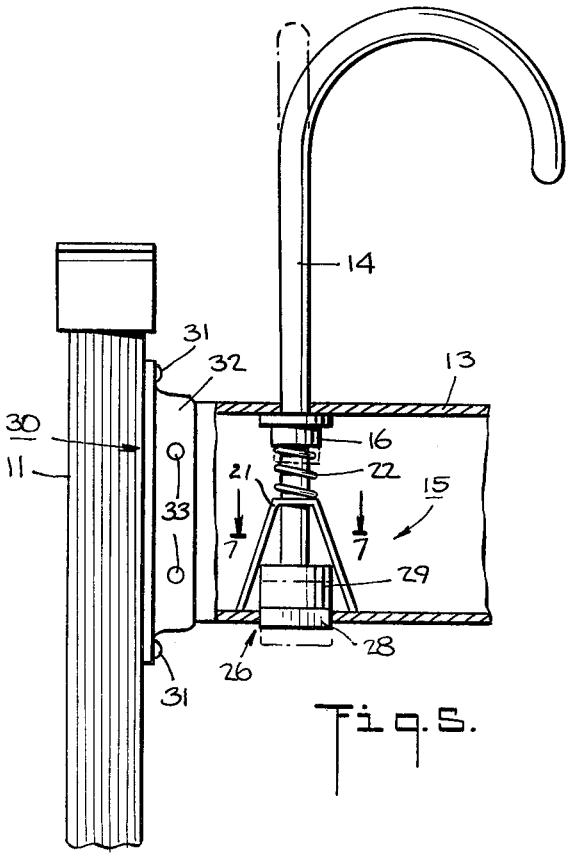
Fig. 5.
Fig. 6.
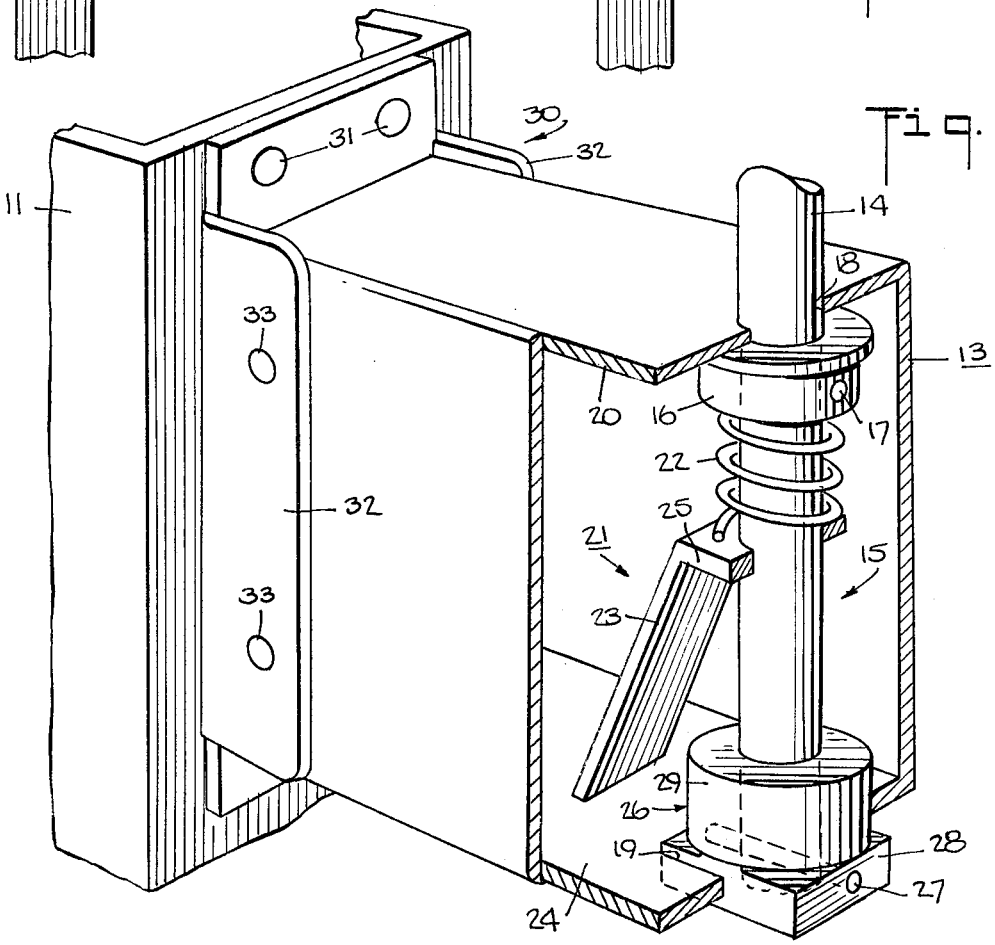

LADDER HOOK ASSEMBLY AND LADDER

This invention relates to a ladder hook assembly and a ladder.

As is known, ladders have been constructed with hook assemblies by means of which the ladder may be hooked over a cable or other means to maintain the ladder in a position, such as a vertical position, for use. In order to permit ready storage of such ladders, the hooks have frequently been mounted as separable units on the ladder or by means of various retractable assemblies so as to be pivoted into a flatted condition relative to the ladder. Ladders of this latter type of construction are described in U.S. Pat. No. 3,590,951 and U.S. Pat. No. 675,545. In many cases, the assemblies for pivoting the hooks have been mounted in an exposed manner as well as in brackets secured directly on the side rails of the ladder. However, because of the exposure of the retractable assemblies, these assemblies may be subjected to damage and at least to weathering. Further, the exposure of the assemblies, may allow external forces to foul or otherwise encumber the proper functioning of the assemblies. Also, the exposure of the various components of the retractable assemblies may cause injury to the personnel manipulating the assemblies during use should one catch a finger or hand therein. In addition, the strengh of such retractable assemblies generally rely on a combination of fastenings at the ladder and bracket as well as on an intermediate connection between the bracket and a top rung of the ladder in those cases where the top rung is mounted between the brackets of two oppositely disposed retractable assemblies.

Accordingly, it is an object of the invention to provide a ladder with a retractable hook assembly which is enclosed.

It is another object of the invention to provide a ladder hook assembly which can be mounted in a ladder rung.

It is another object of the invention to provide a ladder with a hook assembly which can be readily mounted on the side rails of the ladder.

It is another object of the invention to provide a ladder hook assembly which provides a reliable locking mechanism for securing the hook in a storage condition or a condition of use.

It is another object of the invention to provide a ladder with a hook assembly which is retractable and which is of relatively simple construction.

It is another object of the invention to provide a ladder with a hook assembly which can be easily fabricated and assembled.

It is another object of the invention to provide a ladder with a hook assembly which is of relatively strong construction.

It is another object of the invention to provide a ladder and hook assembly which is made of relatively few components.

It is another object of the invention to provide a positive locking arrangement for a retractable hook of a ladder.

Briefly, the invention provides a ladder hook assembly which comprises a ladder rung, at least one hook having a shank passing through the rung, and a locking mechanism securing the hook to the rung for selective rotation relative to the rung. The construction of the rung and the locking mechanism allows the hooks to be disposed parallel to the rung in a stored position or at a 90° angle to the rung when in use.

The ladder rung is of hollow construction and has, for example, a rectangular cross-sectional shape distinct from the remaining rungs of the ladder. In addition, the rung has a first aperture in an upper surface and a second aperture in a lower surface aligned with the first aperture while the hook includes a shank which passes through these apertures as well as through the rung.

The locking mechanism includes a shaped non-circular peripheral surface which is matingly received in the second aperture, i.e. the underside surface, of the rung in order to selectively lock the hook in at least one of two positions relative to the rung. In addition, the locking mechanism includes spring means which bias the rung outwardly of the first aperture.

In one particular embodiment, the locking mechanism includes a collar which is secured to the shank of a hook within the rung and which is disposed in abutment with the upper interior surface of the rung. In addition, the locking mechanism includes a spring means which biases the collar into abutment with this upper interior surface. The spring means further includes an expandable locking anchor located within the rung and a compression spring between the anchor and the collar so as to bias the collar away from the anchor.

The locking mechanism also includes a locking means which is secured to the shank and which has the shaped peripheral surface thereon for mating in the aperture of the rung. This peripheral surface is formed, for example, on a square head and is of a thickness sized to be moved out of mating relation with the aperture upon movement of the hook into the rung against the biasing of the spring means. This locking means also includes a cylindrically shaped section adjacent the head which is of a diameter equal to a side dimension of the head. This allows the cylindrical shaped section to maintain alignment of the hook shank in the apertures of the rung during rotation of the hook.

A ladder may be provided with a pair of hook assemblies or with any other suitable number, for example, depending on the width or size of the ladder. Similarly, scaffolding may be provided with these hook assemblies.

The ladder hook assembly can be incorporated into a ladder by any suitable means such as a pair of brackets, each of which is secured to a side rail of the ladder. To this end, the brackets may be made of any suitable shape to receive the ends of the hollow rung while suitable means, such as rivets, are provided to secure the rung to the respective brackets. Similar rivets or other suitable means may be used to secure the bracket to the ladder side rails. This provides a strength which is not dependent upon fastenings intermediately in the span between the side rails.

By retaining the locking mechanism within the rectangular hollow rung, there are no springs or locking mechanism to foul the user. Further, the locking is positive in as much as there is no way to rotate the hooks as long as no downward pressure is applied on the top of the hooks.

These and other objects and advantages of the invention will become more apparent from the following detailed description and appended claims taken in conjunction with the accompanying drawings in which:

FIG. 1 illustrates a perspective view of a ladder in an upright position utilizng a ladder hook assembly according to the invention;

FIG. 2 illustrates the hook assembly of FIG. 1 in a storage condition;

FIG. 3 illustrates a view taken on line III—III of FIG. 1;

FIG. 4 illustrates a view taken on line IV—IV of FIG. 1;

FIG. 5 illustrates a part cross-sectional view of the hook assembly with a hook in a storage condition;

FIG. 6 illustrates an enlarged view of a locking mechanism according to the invention; and FIG. 7 illustrates a view taken on line VII—VII of FIG. 5.

Referring to FIG. 1, a ladder 10 is constructed with a pair of side rails 11 and a plurality of rungs 12 which interconnect the side rails 11 in any suitable fashion. In addition, the ladder 10 includes a hook assembly at the upper end. This hook assembly includes the uppermost rung 13 which is made of hollow construction as well as of a different cross-sectional shape from the remainder of the rungs 12. For example, the uppermost rung 13 is made of rectangular cross section. In addition, the hook assembly includes a pair of hooks 14 which are mounted in the uppermost rung 13 for supporting the ladder 10 from a suitable means such as a cable (not shown).

Each of the hooks 14 is mounted so as to be selectively rotated relative to the rung 13 from a storage position (FIG. 2) parallel to the rungs 12, 13 or to an outward position of use (FIG. 1). For this purpose, each hook 14 is associated with a locking mechanism 15 (FIG. 3) within the uppermost rung 13 which serves to lock the hook 14 in either of the two positions and which also serves to permit rotation or pivoting of each hook 14 between these positions.

Referring to FIGS. 3, 4 and 6, the locking mechanism 15 includes a shaped collar 16, for example of metal, which is secured to a shank of the hook 14 within the rung 13 by means of a pin 17 which passes through a hole in the collar 16 into a recess in the hook shank. As shown, each hook 14 passes through a circular aperture 18 in an upper surface of the rung 13 and an enlarged aperture 19 of rectangular cross section in a lower surface of the rung 13. The collar 16 is sized of a diameter larger than the aperture 18 in the upper surface of the rung 13 so as to prevent passage of the hook 14 upwardly out of the rung 13 as viewed.

In addition, the locking mechanism also includes a spring means within the rung 13 which biases the collar 16 into abutment with the upper interior surface 20 of the rung 13. This spring means includes an expandable locking anchor 21, for example of metal, and a compression spring 22 between the anchor 21 and the collar 16. As shown in FIG. 4, the locking anchor 21 is made substantially U-shaped with a pair of legs 23 which rest on the lower interior surface 24 of the rung 13 and an apertured horizontal cross-piece 25 which passes about the hook shank and seats the compression spring 22 thereon. As indicated in FIG. 4, the legs 23 of the anchor 21 are disposed out of alignment with the aperture 19 in the lower side of the rung 13.

The locking mechanism 15 also includes a locking means 26 which is secured to the shank of the hook 13 by means of a pin 27 passing through suitable bores in the hook shank and locking means 26 in order to retain the hook 13 in a given position. As shown, the locking means 26 has a shaped peripheral surface which is matingly received in the square aperture 19. This surface is formed by a square head 28 and is of a thickness to move out of mating relation with the square aperture 19 upon movement of the hook 14 into the rung 13 against the biasing of the compression spring 22. The locking means 26 also has a cylindrically shaped section 29 adjacent to the head 28 which is of a diameter equal to a side dimension of the head 28. This allows the cylindrical section 29 to maintain alignment of the hook shank within the rung apertures 18, 19 during rotation of the hook 14 between the storage and use positions.

In order to assemble a hook assembly, a hook 14 is first passed through the apertures 18, 19 in the hollow rung 13. Next, the collar 16 is secured to the hook 14 by passage of the pin 17 through the hole in the collar 16 into the recess in the hook 14. Next, the compression spring 22 is placed about the shank along with the anchor 21. The collar 16, spring 22 and anchor 21 are then passed through the square aperture 19 in the lower side of the rung 14. At this time, the horizontal cross-piece 25 of the locking anchor 21 passes through the aperture 19, being of smaller size than the aperture 19, while the legs 23 are pressed together to pass through the aperture 19. After passage, the legs 22 spring outwardly to form a positive mounting of the assembly 15 within the rung 13. Thereafter, the hook 14 is pushed into the rung 13 against the biasing force of the spring 22. At this time, the locking means 26 is secured to the shank by passage of the pin 27 through the bore in the square head 28 and the bore in the hook shank. Thereafter, the hook 14 is released so that the spring 22 brings the square head 28 into alignment with the walls of the square aperture 19 in the lower side of the rung 13.

Referring to FIGS. 1 and 6, in order to mount the hook assembly on the ladder 10, a pair of brackets 30 of generally channel-shaped cross section are mounted on each side rail 11, for example by means of bolts or rivets 31. Each bracket 30 includes a pair of flanges 32 which extend toward the opposite side rail 11. These flanges 32 are spaced apart to receive the hollow rung 13 therebetween. In addition, both the hollow rung 13 and the flanges 32 are provided with suitable apertures for passage of bolts or rivets 33 therethrough.

It is to be noted that the brackets 30 may be mounted on each side rail 11 initially and the hollow rung 13 mounted thereafter by the use of blind rivets or elongated pins. Alternatively, the brackets 30 may be mounted on the ends of the hollow rung 13 before being mounted on the side rails 11. In this latter case, the brackets 30 may be provided with an aperture (not shown) aligned with the opening in the ends of the rung 13 so as to facilitate mounting of the rivets or pins which secure the brackets to the rung.

Referring to FIG. 1, when in use, the ladder 10 has the rungs 14 turned outwardly in a position of use so as to be hooked over a suitable structure or other means. In order to turn the hooks 14 into the storage condition as shown in FIG. 2, the hooks 14 are pushed downwardly into the hollow rung 13. At this time, the square head 28 on the locking means 26 moves out of mating engagement with the square aperture 19 in the lower side of the rung 13. Thereafter, the hook 14 can be rotated, for example, 90° and then released so that the square head 28 of the locking means 26 moves back into mating relation with the square aperture 19 of the rung 13. The hook 14 will then be in the locked storage position.

It is to be noted that the locking means may be provided with other suitable surfaces other than a square periphery for engaging in a shaped non-circular aperture 19 in the lower surface of the rung 13. For example, the head 28 may be of hexagonal shape.

The side rails 11 and hollow rung 13 can be made of any suitable structural material, such as metals, wood, plastic, glass fiber reinforced plastics and the like.

The invention provides a ladder with a hook assembly which is entirely encased within the rung of the ladder so as to avoid weathering, corrosion and damage by outside influences. Further, by maintaining the locking assembly in an enclosed condition, the risk of injury to personnel can be reduced. The invention further provides a ladder hook assembly which is relatively clean and foul free and which is made of relatively few components.

Further, by making the upper rung of the ladder of a different cross-sectional shape from the remaining rungs of the ladder, this difference in shape may be used to alert a user by feel when the top rung is reached.

Finally, the invention provides a ladder hook assembly which is of relatively strong construction.

What is claimed is:

1. A ladder hook assembly comprising a hollow ladder rung;

at least one hook having a shank passing through said rung; and a locking mechanism securing said hook to said rung for selective rotation relative to said rung, said locking mechanism including a collar secured to said shank within said rung and disposed in abutment with an upper interior surface of said rung, and spring means within said rung biasing said collar into abutment with said upper interior surface, said spring means including an expandable locking anchor within said rung and a compression spring between said anchor and said collar.

2. A ladder hook assembly comprising a hollow ladder rung;

at least one hook having a shank passing through said rung; and a locking mechanism securing said hook to said rung for selective rotation relative to said rung, said locking mechanism including a collar secured to said shank within said rung and disposed in abutment with an upper interior surface of said rung, spring means within said rung biasing said collar into abutment with said upper interior surface, and a locking means secured to said shank, said locking means having a shaped non-circular peripheral surface thereon matingly received in an aperture in a lower portion of said rung, said surface being sized of a thickness to move out of mating relation with said aperture upon movement of said hook into said rung against the biasing of said spring means.

3. A ladder comprising a pair of side rails;

a plurality of rungs interconnecting said side rails;

a pair of hooks, each said hook having a shank passing through an aperture in an upper one of said rungs; and a locking mechanism securing each respective hook to said one rung for selective rotation relative to said one rung, each said locking mechanism including a shaped peripheral surface matingly received in said aperture to selectively lock said hook in at least one of two positions relative said one rung.

4. A ladder hook assembly comprising a ladder rung;

at least one hook having a shank passing through said rung; and a locking mechanism securing said hook to said rung for selective rotation relative to said rung, said locking mechanism including a locking means having a shaped non-circular peripheral surface thereon matingly received in an aperture in a portion of said rung.

5. A ladder hook assembly as set forth in claim 1 wherein said rung is hollow and said locking mechanism further includes a collar secured to said shank within said rung and disposed in abutment with an upper interior surface of said rung, and spring means within said rung biasing said collar into abutment with said upper interior surface.

6. A ladder hook assembly as set forth in claim 5 wherein said spring means includes an expandable locking anchor within said rung and a compression spring between said anchor and said collar.

7. A ladder hook assembly as set forth in claim 5 wherein said locking means is secured to said shank.

8. A ladder hook assembly as set forth in claim 7 wherein said locking means includes a square head forming said shaped peripheral surface and a cylindrically shaped section adjacent said head of a diameter equal to a side dimension of said head to maintain alignment of said hook shank in said rung during rotation of said hook.

9. A ladder hook assembly as set forth in claim 8 wherein said spring means includes an expandable locking anchor within said rung and a compression spring between said anchor and said collar.

10. a ladder comprising a pair of side rails;

a plurality of rungs interconnecting said side rails;

a pair of hooks, each said hook having a shank passing through an upper one of said rungs; and a locking mechanism securing each respective hook to said one rung for selective rotation relative to said one rung, each said mechanism including a shaped non-circular peripheral surface thereon matingly received in an aperture in a portion of said rung.

11. A ladder hook assembly as set forth in claim 10 wherein said locking mechanism further includes spring means biasing said rung outwardly of said first aperture.

12. A ladder hook assembly as set forth in claim 11 wherein said rung is hollow and said spring means is located within said rung.

13. A ladder comprising a pair of side rails;

a plurality of rungs interconnecting said side rails;

a pair of hooks, each said hook having a shank passing through an upper one of said rungs; and a locking mechanism securing each respective hook to said one rung for selective rotation relative to said one rung.

14. A ladder as set forth in claim 13 which further comprises a pair of brackets, each said bracket being secured to a respective side rail and to a respective end of said one rung.

15. A ladder as set forth in claim 13 wherein said one rung is hollow.

16. A ladder as set forth in claim 13 wherein each said locking mechanism includes a collar connected to said shank within said one rung and disposed in abutment with an upper interior surface of said one rung, and spring means within said rung biasing said collar into abutment with said upper interior surface.

17. A ladder as set forth in claim 13 wherein said one rung is of a different cross-sectional shape from the remaining rungs.

* * * * *

UNITED STATES PATENT AND TRADEMARK OFFICE

CERTIFICATE OF CORRECTION

PATENT NO. : 4,089,390

DATED : May 16, 1978

INVENTOR(S) : Philippe McLain

It is certified that error appears in the above-identified patent and that said Letters Patent are hereby corrected as shown below:

Column 2, line 37, "cylindrical" should be --cylindrically--
Column 5, line 4, "metals" should be --metal--
Column 6, line 7, change "1" to --4--
Column 6, cancel claim 10 and substitute therefore:

10. A ladder hook assembly comprising a ladder rung having a first aperture in an upper surface and a second aperture in a lower surface, said apertures being disposed in alignment;

a hook having a shank passing through said apertures and through said rung; and a locking mechanism securing said hook to said rung for selective rotation relative to said rung, said locking mechanism including a shaped non-circular peripheral surface matingly received in said second aperture to selectively lock said hook in at least one of two positions relative to said rung.

Column 6, line 53, after "rung" insert --, each said mechanism including a shaped non-circular peripheral surface thereon matingly received in an aperture in a position of said rung--

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*